United States Patent [19]

Ishikawa et al.

[11] Patent Number: 4,727,342

[45] Date of Patent: Feb. 23, 1988

[54] DIELECTRIC RESONATOR

[75] Inventors: Youhei Ishikawa, Kyoto; Jun Hattori, Nagaokakyo, both of Japan

[73] Assignee: Murata Manufacturing Co., Ltd., Japan

[21] Appl. No.: 910,128

[22] Filed: Sep. 22, 1986

[30] Foreign Application Priority Data

Sep. 24, 1985 [JP] Japan ..... 60-210598

[51] Int. Cl.[4] ..... H01P 7/10; H01P 1/201; H01P 1/203

[52] U.S. Cl. ..... 333/219; 333/202; 333/204; 333/245

[58] Field of Search ..... 333/202, 204, 205, 208–212, 333/219, 206–207, 227, 235, 245, 246; 331/96, 107 DP, 107 SL, 107 C

[56] References Cited

U.S. PATENT DOCUMENTS 4,477,785 10/1984 Atia ..... 333/219 X

FOREIGN PATENT DOCUMENTS 1099338 6/1984 U.S.S.R. ..... 333/202

*Primary Examiner*—Marvin L. Nussbaum

*Attorney, Agent, or Firm*—Ostrolenk, Faber, Gerb & Soffen

[57] ABSTRACT

A dielectric resonator employing the TM mode as its resonance mode, which is provided with a dielectric base plate on which an electronic circuit is formed and a pair of electrodes formed in face-to-face relation to each other on respective major surfaces of the dielectric base plate. A plurality of through-holes are defined between the pair of electrodes on their circumferential portions and both of the electrodes are connected with each other by way of conductive material formed on the inner surfaces of the through-holes.

5 Claims, 5 Drawing Figures

DIELECTRIC RESONATOR

BACKGROUND OF THE INVENTION

The present invention generally relates to a resonance apparatus and more particularly, to a dielectric resonator which is integrally incorporated into a dielectric base plate on which an electronic circuit is formed.

As shown in FIG. 1, one conventional filter employing a dielectric resonator therein has been so constructed as to accommodate a dielectric resonator 4 of a columnar or cylindrical shape or the like within a metallic case 2, with the dielectric resonator 4 being supported by a support member 6 of an insulating material. In some cases, the metallic case 2 has been so designed as to internally accommodate an electronic circuit, for example, an MIC (Microwave Integrated Circuit) and such being the case, the dielectric resonator 4 is placed on a dielectric base plate 8 which is provided for the MIC, the base-plate 8 supporting the supporting member 6, and the base plate 8 also being connected with a microstrip line 10 communicating with the MIC and with proper positional relationship therebetween. There are illustrated in FIG. 1, magnetic lines M of force in the case where a resonance mode of the dielectric resonator 4 is the TE mode.

As stated above, when the dielectric resonator 4 is used in this way connected with an MIC or the like, the filter portion where the dielectric resonator 4 is located, is elevated extremely high as compared with the other circuit components, which causes the drawback that a large space is necessarily required. In addition, there has been also the drawback that a whole electronic circuit including the aforementioned dielectric resonator 4 therein must be manufactured at a high cost owing to the fact that the dielectric resonator 4 differs from the dielectric base plate 8 in material.

SUMMARY OF THE INVENTION

Accordingly, the present invention has been developed with a view to substantially eliminating the above described drawbacks inherent in an electronic circuit including the prior art dielectric resonator therein, and has for its essential object to provide an improved dielectric resonator whereby a circuit structure which is thin in thickness can be manufactured at a low cost.

Another object of the present invention is to provide a dielectric resonator of the above described type which is simple in construction and superior in reliability.

In accomplishing these and other objects, according to one preferred embodiment of the present invention, there is provided a dielectric resonator employing the TM mode as a resonance mode thereof, said dielectric resonator including a dielectric base plate on which an electronic circuit is formed and a pair of electrodes formed in fact-to-face relation to each other on respective major surfaces of the dielectric base plate, wherein a plurality of through-holes are defined between the pair of electrodes on the circumferential portions thereof and both of the electrodes are connected with each other by way of the through-holes.

In such dielectric resonator, the TM mode is utilized as a resonance mode thereof and since both of the electrodes facing each other are connected with each other at the circumferential portions thereof by way of the through-holes, a boundary condition is preferably set and this results in an entrapment of an electromagnetic field. Furthermore, since a resonance frequency has no connection with the thickness of the dielectric resonator but is determined by the area of the electrodes, it causes no problem to employ the dielectric base plate which is thin in thickness. Accordingly, a thin electronic circuit including the dielectric resonator of the present invention therein can be manufactured at a low cost.

BRIEF DESCRIPTION OF THE DRAWINGS

These and other objects and features of the present invention will become apparent from the following description of an embodiment thereof with reference to the accompanying drawings, throughout which like parts are designated by like reference numerals, and in which.

DETAILED DESCRIPTION OF THE PREFERRED EMBODIMENT

Figure 2:
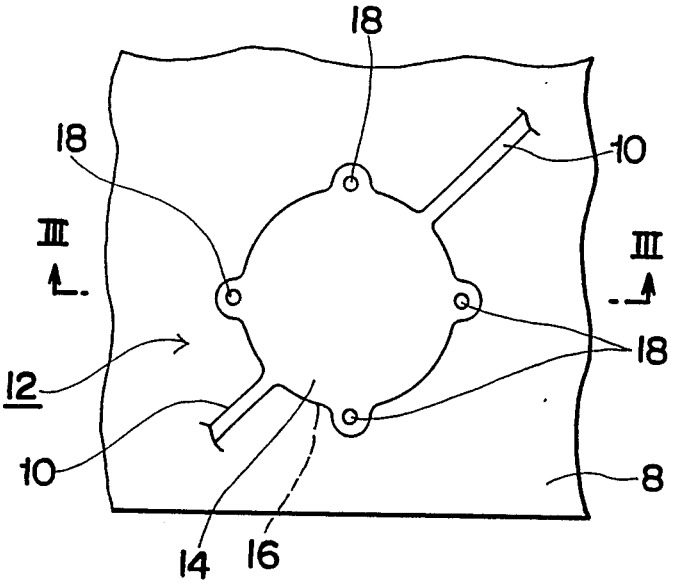
FIG. 2 is a top plan view of a dielectric resonator of the present invention according to one preferred embodiment thereof.

Referring now to the drawings, FIG. 2 illustrates a dielectric resonator 12 according to one preferred embodiment of the present invention, which is integrally incorporated into a dielectric base plate 8 on which an electronic circuit such as an MIC or the like is formed. More particularly, in the dielectric resonator 12, a pair of electrodes 14 and 16, each of which is, for example, circular or polygonal in shape are formed in face-to-face relation to each other on respective major surfaces of the dielectric base plate 8 and a plurality of, for example, four through-holes 18 are defined between the pair of electrodes 14 and 16 on the circumferential portions thereof. Both of the electrodes 14 and 16 are connected with each other by way of the through-holes 18, more specifically, by way of electrodes 20 formed on the inner surfaces of respective through-holes 18.

Figure 3:
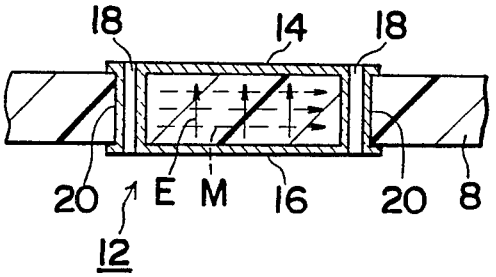
FIG. 3 is a cross section taken along the line III—III of FIG. 2.

In this kind of dielectric resonator 12, the TM mode, more specifically, the $TM_{010}$ mode is utilized as a dominant resonance thereof. FIG. 3 schematically illustrates therein electric lines E of force and magnetic lines M of force in such dielectric resonator 12.

In the TM mode, since a resonance frequency of the dielectric resonator 12 has no connection with the thickness of the dielectric base plate 8 but is determined by the area of the electrodes 14 and 16, nothing interferes with obtaining a required resonance frequency, even if the dielectric resonator 12 is directly incorporated into the dielectric base plate 8 which is thin in thickness.

However, if the dielectric resonator 12 only consisted of the electrodes 14 and 16 simply disposed only on respective major surfaces of the dielectric base plate 8, an electromagnetic field would leak out of the dielectric resonator 12, in the TM mode, in a direction in which the dielectric base plate 8 extends, and this undesirably results in the dielectric resonator being of no use. Accordingly, to avoid this problem, the electromagnetic field is entrapped under a boundary condition which is set by communicating both electrodes 14 and 16 with each other by way of the through-holes 18.

In such case, since the electromagnetic field can be increasingly entrapped as a greater number of through-holes 18 are disposed in the dielectric resonator 12, an increased unloaded Q thereof can be obtained. Furthermore, with respect to the configuration of the electrodes 14 and 16, to the extent their configuration becomes more similar to a circle, the increased unloaded Q can be also preferably obtained.

As for the connection between the dielectric resonator 12 and the electronic circuit formed on the dielectric base plate 8, each of the microstrip lines 10 for input and output use may be directly connected to the electrode 14 or 16, as shown, for example, in FIG. 2, or the microstrip line 10 may be indirectly coupled thereto through an electrostatic capacitance by arranging the microstrip line 10 close to the electrode 14 or 16 or the like.

Figure 4:
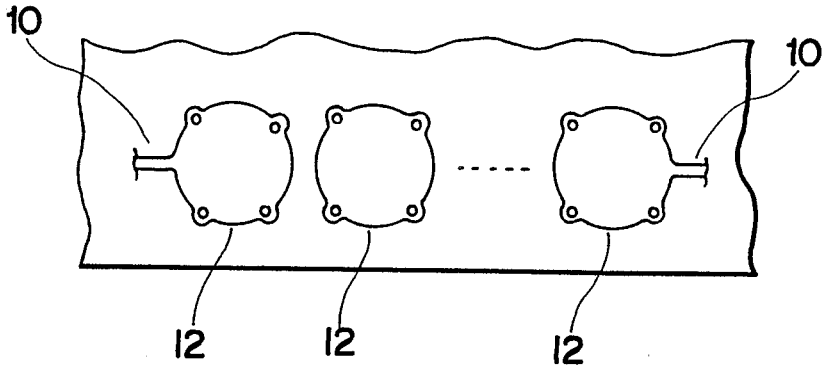
FIG. 4 is a top plan view of a band-pass filter having therein a plurality of dielectric resonators of the present invention.

Furthermore, as shown in FIG. 4, a band-pass filter having therein a required number of the dielectric resonators 12 can be manufactured according to the present invention by arranging the dielectric resonators 12 side by side at regular intervals, with both of the dielectric resonators 12 disposed on respective ends thereof being directly connected to the microstrip lines 10.

Figure 5:
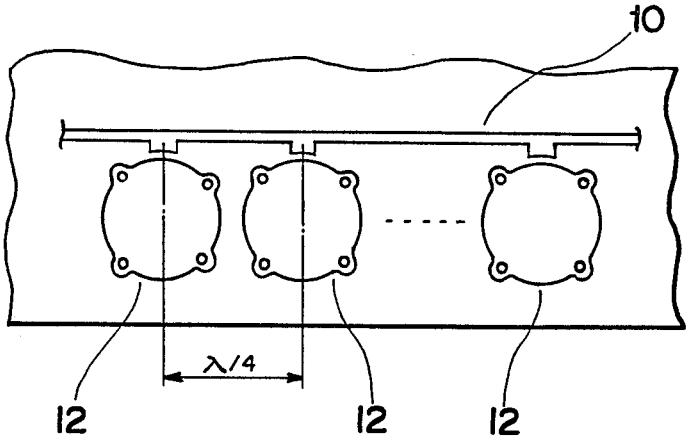
FIG. 5 is a top plan view of a band-elimination filter having therein a plurality of dielectric resonators of the present invention.

In addition, as shown in FIG. 5, a band-elimination filter having therein a required number of the dielectric resonators 12 can be also manufactured by arranging the dielectric resonators 12 side by side at regular intervals of a quarter of the resonance wave length (λ), with the microstrip line 10 being so disposed as to be spaced from the dielectric resonators 12 in the vicinity thereof.

Figure 1:
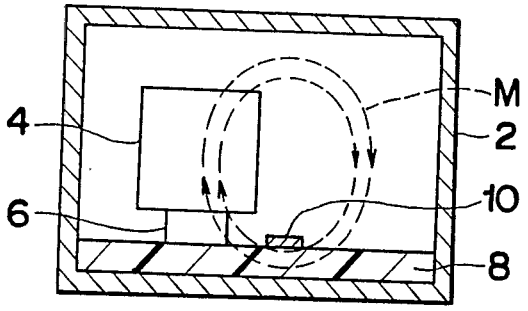
Fig. 1 PRIOR ART
FIG. 1 is a sectional view of a filter internally accommodating a prior art dielectric resonator.

By employing the above described dielectric resonator 12, since it becomes possible to completely eliminate any projection substantially out of the plane of the dielectric base plate 8 which is one of the disadvantages inherent in the conventional dielectric resonator 4 as illustrated in FIG. 1, the whole circuit can be formed to be thin in thickness, thus resulting in the circuit of small size. Moreover, according to the present invention, unlike the conventional case, since the dielectric resonator 12 or the like can be formed of the same material as that of the dielectric base plate 8, the amount of the required material can be advantageously reduced, and as a result, the electronic circuit including therein the dielectric resonator of the present invention can be manufactured at a low cost.

Although the present invention has been described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A dielectric resonator employing the TM mode as the resonant mode thereof, comprising:

a dielectric base plate having at least one microstrip line of an electronic circuit formed thereon; and a pair of electrodes formed in face-to-face relation to each other on respective major surfaces of said dielectric base plate;

wherein a plurality of through-holes are defined in said dielectric base plate between said pair of electrodes near circumferential portions thereof and both of said electrodes are connected with each other by way of conductive material disposed in said through-holes, said resonator thereby employing said TM resonant mode.

2. A dielectric resonator as claimed in claim 1, wherein each of said pair of electrodes has a circular configuration.

3. A dielectric resonator as claimed in claim 1, wherein at least one of said pair of electrodes is directly connected to said microstrip line for connection with said electronic circuit.

4. A dielectric resonator as claimed in claim 1, wherein at least one of said pair of electrodes is disposed close to said microstrip line for coupling with said electronic circuit through an electrostatic capacitance between said electrode and said microstrip line.

5. A dielectric resonator employing the TM mode as the resonant mode thereof, comprising:

a dielectric base plate; and a pair of electrodes formed in face-to-face relation to each other on respective major surfaces of said dielectric base plate;

wherein a plurality of through-holes are defined in said dielectric base plate between said pair of electrodes near circumferential portions thereof and both of said electrodes are connected with each other by way of conductive material disposed in said through-holes, said resonator thereby employing said TM resonant mode.

* * * * *